United States Patent [19]

Goris et al.

[11] Patent Number: 4,611,663

[45] Date of Patent: Sep. 16, 1986

[54] CASING HANGER AND RUNNING APPARATUS

[75] Inventors: Gregg A. Goris, Oxnard; John Pettit, Camarillo, both of Calif.

[73] Assignee: Vetco Offshore Industries, Inc., Ventura, Calif.

[21] Appl. No.: 719,383

[22] Filed: Apr. 2, 1985

[51] Int. Cl.[4] ..... E21B 43/10

[52] U.S. Cl. ..... 166/382; 166/124; 166/208

[58] Field of Search ..... 285/39; 166/382, 387, 166/124, 208, 182, 123, 125

[56] References Cited

U.S. PATENT DOCUMENTS

| | | | |
|---|---|---|---|
| 3,887,006 | 6/1975 | Pitts | 166/124 |
| 4,349,071 | 9/1982 | Fish | 166/124 |
| 4,388,971 | 6/1983 | Peterson | 166/382 |
| 4,478,435 | 10/1984 | Cheshier et al. | 285/39 |
| 4,548,273 | 10/1985 | Leicht et al. | 166/182 |

*Primary Examiner*—Stephen J. Novosad
*Assistant Examiner*—William P. Neuder
*Attorney, Agent, or Firm*—Joseph R. Dwyer

[57] ABSTRACT

Disclosed is a casing hanger 10 and running apparatus 16 wherein the casing hanger 10 is mechanically supported by a running thread ring 70 onto a running tool 20 for lowering into a wellhead 12, and wherein the packoff assembly 14 is held above the casing hanger 10 for circulating and cementing operations for improved flowby capabilities and wherein the packoff assembly 14 is mechanically lowered and energized to seal the annular seal area 32 comprising threading the packoff apparatus from the running apparatus 16 onto the casing hanger by rotation of the running tool 20, which concurrently also releases the casing hanger 10 from the running tool 20 by unthreading the primary thread ring 70 therefrom.

27 Claims, 11 Drawing Figures

Fig. 1.
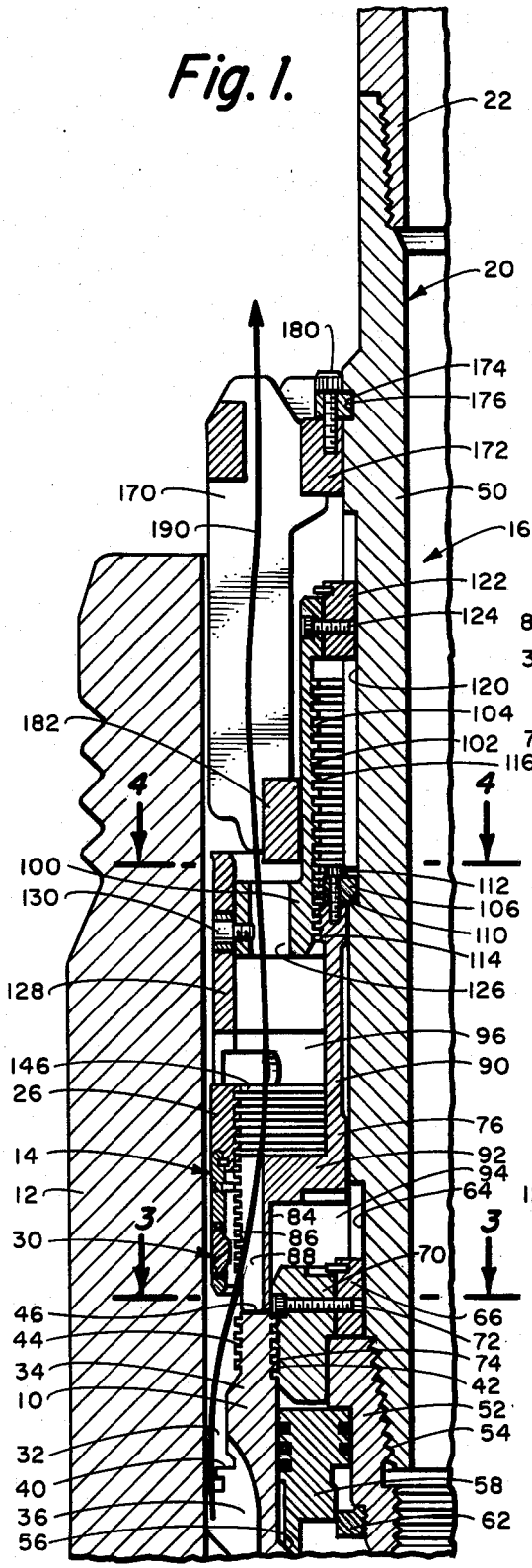
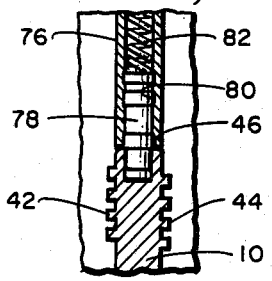
Fig. 2.
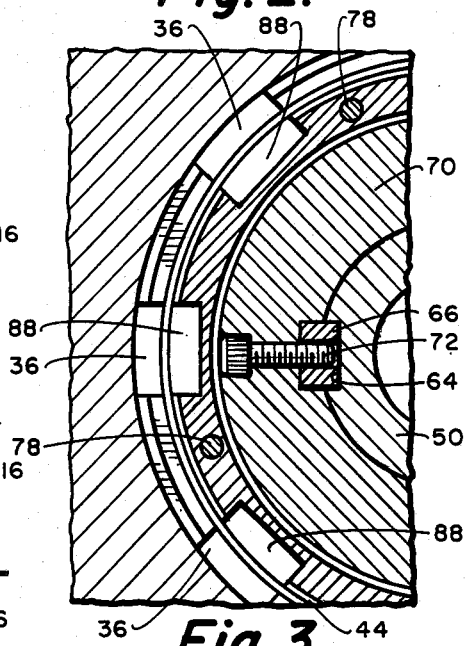
Fig. 3.
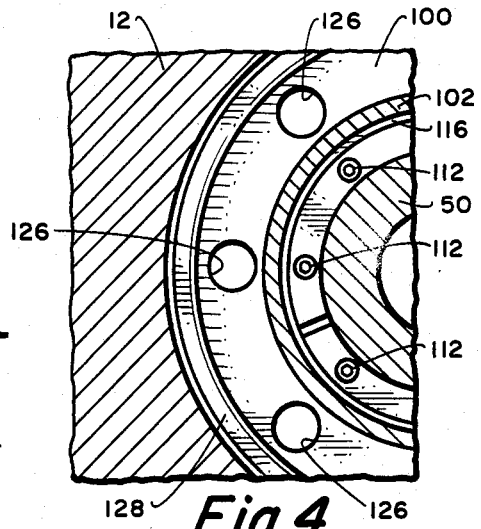
Fig. 4.

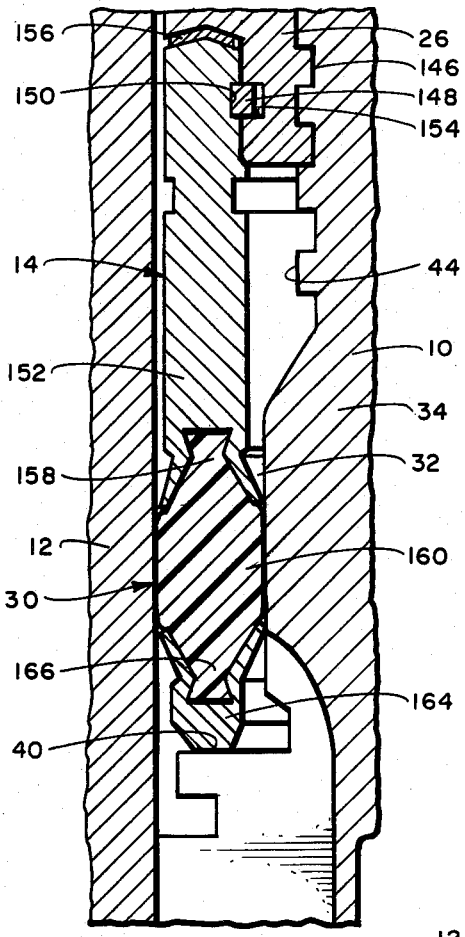
Fig. 9.
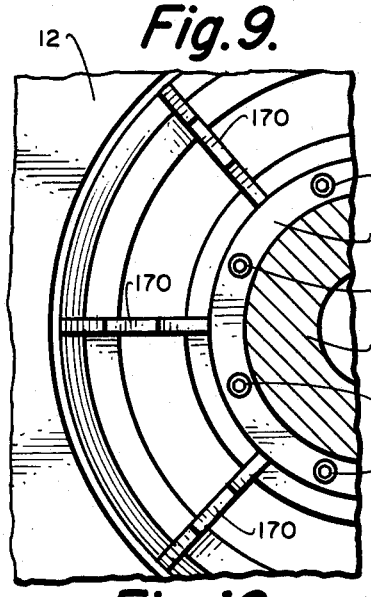
Fig. 10.
Fig. 11.
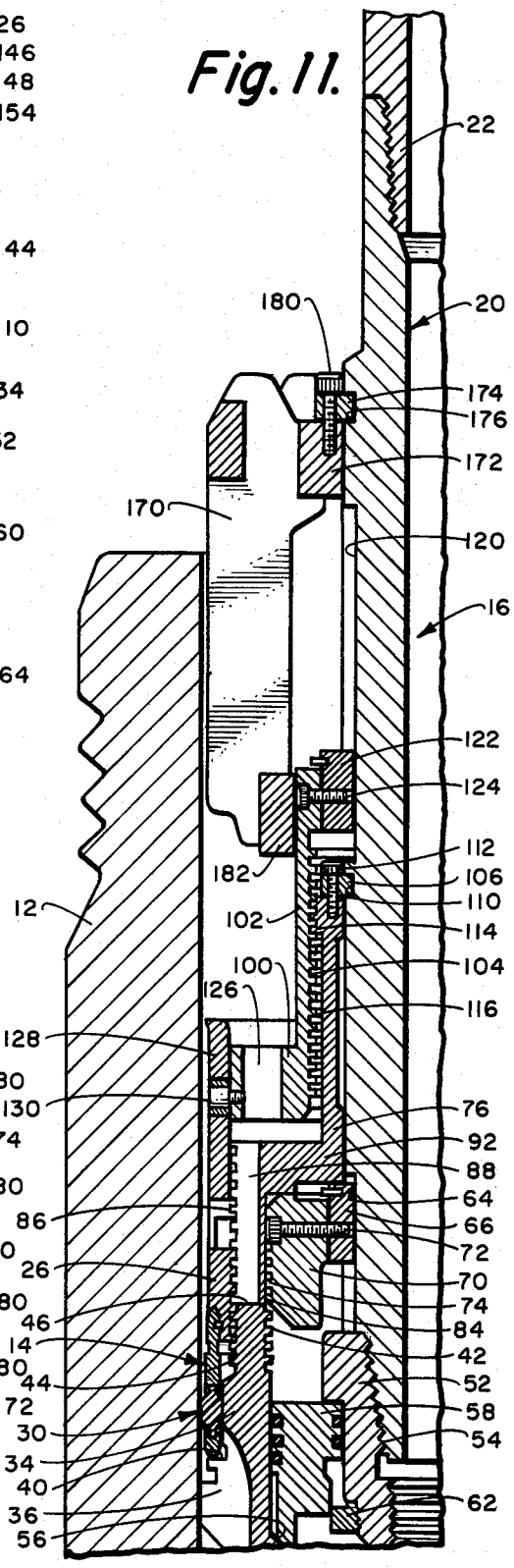

CASING HANGER AND RUNNING APPARATUS

BACKGROUND OF THE INVENTION

The present invention relates to well apparatus and, in particular, to underwater apparatus for running a casing string into the well bore, cementing the casing string in place, and sealing the annular seal region between a casing hanger body and the surrounding wellhead bore.

In the drilling of oil and gas wells at an underwater location, a casing string is run into a well bore, and supported by a hanger body resting on complementary seats within a surrounding wellhead. After the casing string is cemented in place, a suitable seal assembly, referred to as a packoff assembly, is actuated (energized) to packoff (seal) the annular seal region between the exterior of the hanger body and the surrounding wellhead. Apparatus for performing the above method is illustrated in a number of U.S. Patents, such as, for example, U.S. Pat. Nos. 3,468,558, 3,468,559, 3,489,436, 3,492,026, and 3,871,449.

In such apparatus, the casing hanger body and packoff assembly are lowered into position at the same time on a running tool. In some of the above apparatus, the packoff assembly is lowered into position initially connected to the casing hanger, while in other apparatus, such as shown in U.S. Pat. No. 3,871,449, the packoff assembly is not connected initially to the hanger body, but is supported above the hanger body through an intermediary device which is responsive to actuation by the running tool. After the hanger body and packoff assembly have landed within the wellhead, and after cementing has taken place, the running tool is released from the hanger body which also actuates the intermediary device(s) permitting the packoff assembly to move downwardly toward the hanger body and then into the annular seal region between the exterior of the hanger body and the interior of the surrounding wellhead. The packing seal portion of the assembly is then energized to packoff (seal) this annular seal region.

In one apparatus, as disclosed in the U.S. Pat. No. 3,871,449, movement of the packoff assembly into threaded engagement with the hanger body is accomplished by actuation of a spring where rotation of the running tool energizes the packoff assembly. In another apparatus, as shown in the U.S. Pat. No. 3,924,678, energization is accomplished by hydraulic fluid operating on a running and setting tool, and then a locking device is used to lock the packoff seal in place. See also U.S. Pat. No. 3,933,202 where weight is used to energize the packoff seal portion of the packoff assembly.

Reference is also made to U.S. Pat. No. 3,797,864 which discloses an axially deformable elastomeric packing.

This invention relates to that type of apparatus in which the packoff assembly is not connected to the hanger body initially, and is an improvement of such prior art by maintaining the packoff assembly above the casing hanger, then mechanically positively moving the packoff assembly downwardly during and after the running tool is released from the casing hanger. This entire operation—seating the casing hanger within the wellhead, cementing the casing hanger in place, packing off the seal region and pressure testing off the seal for leakage—is accomplished in one trip between the vessel and the well. It will be apparent that, with the separation of the packoff assembly and casing hanger, there is improved flowby through the seal region. It should also be apparent that still another feature of the invention is that it enables the casing hanger and running apparatus to be shorter than existing equipment.

SUMMARY OF THE INVENTION

The casing hanger and running apparatus of this invention comprises: a running thread ring, keyed to the stem of a running tool, with external threads engaging internal threads of the casing hanger to releasably connect and support the casing hanger on the running tool; a stationary thread ring with external threads coextensive with external threads on the casing hanger and releasably attached to the upper end of the casing hanger to act as a temporary extension of the casing hanger to support and releasably connect a packoff assembly above the top end of the casing hanger: and a torque drive element, keyed to the running tool stem, with internal threads which mate with a second set of external threads of the stationary thread ring to drive a torque ring releasably connected to the internally threaded packoff assembly onto the external threads of the casing hanger.

The casing hanger and running apparatus are lowered together into position within the wellhead. In its initial landed position with the packoff assembly above the casing hanger, a large flowby path is advantageously available during the circulating and cementing operation. After the cementing has been completed, the running tool is released from the hanger body by rotating, thereby unthreading the running thread ring from the casing hanger which also rotates the torque drive element rotating and thereby threading the packoff assembly downward to threadably connect the packoff assembly to the hanger body. Continued rotation of the running tool affects threading and downward movement of the packoff assembly into the annular seal region between the exterior of the hanger body and the surrounding wellhead and energizes the packoff seal portion thereof to seal the annular seal region.

BRIEF DESCRIPTION OF THE DRAWINGS

FIG. 1 is an elevational view, partly in section, illustrating the running apparatus, casing hanger, running tool stem and packoff assembly landed within a well housing, FIG. 2 is a partial detailed view of one of the fastening pins for locking part of the running apparatus to the casing hanger, FIG. 3 is a partial view, taken along line 3—3 of FIG. 1, showing the details of the running thread ring, FIG. 4 is a partial view, taken along line 4—4 of FIG. 1, showing the details of part of the torque drive element including the flowby apertures, FIG. 9 illustrates the packoff assembly sealing the seal annulus, FIG. 10 is a partial view showing the details of the stabilizer fin, and FIG. 11 is an elevational view, similar to FIG. 1, showing the packoff assembly sealing the seal annulus and showing the running apparatus free of the casing hanger and thus in a position to be retrieved.

DETAILED DESCRIPTION

Figure 5:
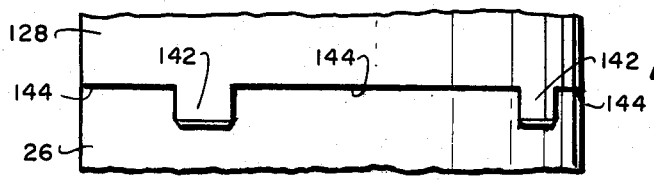
FIG. 5 is a detailed view of a portion of the connection between the torque ring and packoff nut.

In the drilling and completion of oil and/or gas wells from vessels on a body of water, blowout preventer equipment, wellhead housing and casing hanger equipment are located and supported on a base mounted on the floor of the body of water. The casing hangers are supported in the wellhead housing and a plurality of casing hangers are used to support strings of casing (not shown) which extend downwardly into the well. To connect the vessel to the well, a marine riser extends downwardly from the vessel to the blowout preventer which is connected to the wellhead housing.

In the drawings, the invention is depicted with the casing hanger 10 already landed within the wellhead housing 12. This casing hanger 10 is supported by a suitable upwardly facing seat or shoulder (not shown) and was lowered from the vessel to the wellhead housing 12 at the same time as the packoff assembly 14 and running apparatus 16, were lowered by having running tool 20 connected by a tapered thread connection 22 to the lower one of a string of tubing, such as drill pipe. Thus, in FIG. 1, the packoff assembly 14 which comprises a packing nut 26 and a packing seal 30 is shown above the casing hanger 10 still releasably connected on the running apparatus. In this position, the circulating and cementing operations can be conducted in the usual manner. After completion of the cementing operation, the annular seal space 32 between the cylindrical inner wall of the wellhead housing 12 and the opposing cylindrical wall of the casing hanger 10 is sealed by the packoff assembly 14.

The casing hanger 10 shown in the drawing is typical and comprises a main body section 34 provided with a cylindrical inner bore and circulating passages 36 and a packoff actuating shoulder 40. Internal threads 42 and external threads 44 are located near the upper end 46 thereof. For the operation of this invention, it is important that the threads 42 and 44 be opposite, i.e., the threads 42 are left hand and the threads 44 are right hand. The purpose of this will be apparent from the description hereafter.

The running tool 20 has a stem 50 provided at its lower end with a retaining ring 52. This retaining ring may be integral with the stem 50 or, as shown, may be a separate piece threadably supported on externally tapered threads 54 on the stem. This, together with an upwardly facing shoulder 56 on the casing hanger body section 34, support a balance sleeve 58 provided with a plurality of suitably located O-ring seals for high pressure testing. The retaining ring 52 has additional threads and a threaded ring 62 to facilitate assembly of the balance sleeve onto the retaining ring.

Above the retaining ring 52, the running tool stem 50 is provided with a key slot 64 to receive a key 66 suitably affixed to a running thread ring 70. The key 66, in the embodiment illustrated, is fastened to the running thread ring 70 by screws 72 (one shown in FIGS. 1 and 3) and the external surface of the thread ring is threaded at 74 to mate with the internal threads 42 on the casing hanger 10. The running thread ring 70 is capable of moving upwardly relative to the casing hanger body section from the position shown in FIG. 1 by reason of the length of the key slot 64. The running thread ring 70 serves to releasably connect and support the casing hanger on the running tool 20 for lowering into the wellhead housing.

A stationary thread ring 76 is releasably affixed to the upper end 46 of the casing hanger by a plurality of anti-rotation pins 78 in suitable bores 80 on the end of the casing hanger (one pin and bore shown in FIG. 2). These pins are biased by helical spring 82 toward the bores 80 to facilitate their retention within the bores. With the stationary thread ring thus attached to the casing hanger, it acts as an extension of the casing hanger and supports the packoff assembly 26 above the casing hanger. (Keys and key slots may also be used in lieu of the pins 78 and bores 80.) The stationary thread ring 76 has a lower and outer cylindrical portion 84 which has the same outer diameter as the outer diameter of the upper portion of the casing hanger body. This lower outer cylindrical portion is provided with external threads 86 which correspond to the external threads 44 on the casing hanger body. The lower outer cylindrical portion 84 is also provided with a plurality of vertical flowby slots 88 interspersed between the anti-rotation pins 78 (see FIG. 3). This lower outer cylindrical portion 84 is connected to a relatively thin inner sleeve 90 by an intermediate radial ring portion 92. The location of the ring portion 92 relative to the top end of the casing hanger body section provides a first space 94 to allow upward movement of the running thread ring 70 and provides a second space 96 in communication with flowby slots 88 for the flow of fluid from the flow slots 88. Space 96 also allows for clearance for the intermediate radial ring portion 100 and its integral sleeve portion 102 of a torque drive element 104 to move downwardly.

Sleeve 90 loosely engages the outside surface of the running tool stem 50, but is held onto the running tool stem 50 by a split ring 106 within a groove 110 and affixed to the upper end of the sleeve 90 by screws 112 (only one shown). The top portion of this sleeve 90 is externally threaded at 114 to mate with internal threads 116 on the sleeve portion 102 of the torque drive element 104. The sleeve portion 102 is non-rotatably connected relative to the running tool stem 50 by a slot and key arrangement 120 and 122. Again, like the key 66, the key 122 is held on the sleeve portion 102 by screws 124 to facilitate manufacturing and maintenance. Due to the length of the key slot 120 and the clearance provided by the space 96, the sleeve portion 102 and radial ring portions 100 are capable of moving downwardly toward the casing hanger 10 by the action of the threads 114 and 116.

Figure 6:
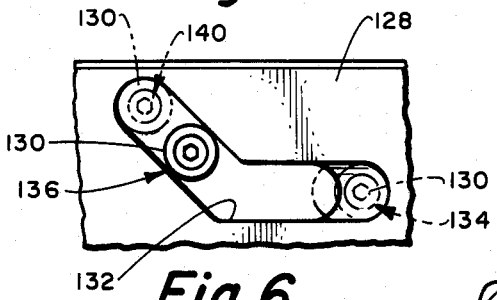
FIG. 6 is a detailed view of a portion of the torque drive element illustrating its connection to the torque ring.
Figure 7:
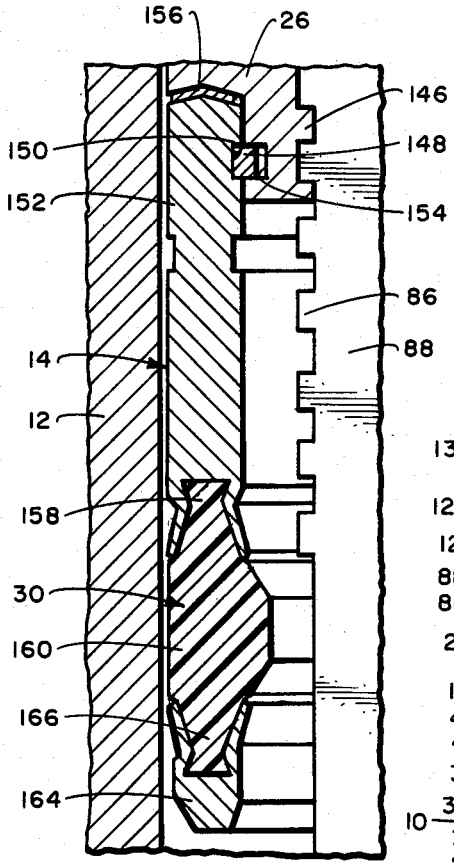
FIG. 7 is an enlarged cross-sectional view of the packoff assembly.

The radial ring portion 100 is provided with a plurality of flowby apertures 126. This ring portion also spaces and supports a torque ring 128 by means of a plurality of radially extending packoff drive pins 130 (one shown in FIGS. 1 and 6) received in multi-level slots 132 in the torque ring 128. These multi-level slots facilitate assembly of the running apparatus. For example, the pin 130 will assume a position 134 during assembly, position 136 during running, and position 140 during torquing to thread the packoff assembly 14 onto the casing hanger 10 and the seal space 32. The outer diameter of this torque ring 128 is substantially coextensive with the outer diameter of the casing hanger, and its lower end is provided with a plurality of tongue and grooves 142 which interdigitate with similar tongue and grooves 144 on the top of the packoff drive nut 26 (see FIG. 5).

The packoff drive nut 26 has internal threads 146 which engage the external threads 86 on the stationary thread ring 76. The packoff seal portion 30 of the packoff assembly 14 is connected to the packoff drive nut 26. While the packoff seal portion of the packing assembly is conventional and is more fully described in the U.S. Pat. No. 3,797,874, it includes a swivel connection accomplished by a split retainer ring 148 mounted in an external groove 150 in a support ring 152 and an internal groove 154 in the packing nut 26. A thrust bearing 156 is provided between the packing nut and the support ring 152 so that the packing nut 26 can be rotated without rotating the support ring 152. The lower end of the support ring 152 engages and supports, by a dovetail connection 158, the upper end of a cylindrical resiliently deformable packing ring 160. A lower abutment ring 164 is connected to the packing ring 160 by a dovetail connection 166.

To complete the description of the mechanical aspects of this invention, attention is directed to FIGS. 1 and 10 and to the top of the running apparatus.

Above the torque drive element 104, there is provided a plurality of centralizers in the form of radially outwardly extending, relatively thin, fins 170 (plates) fixed to a sleeve 172 which surrounds the stem 50 in a rotatable fit and is connected to the running tool stem 50 by a split ring 174 seated in a suitable groove 176 in the stem. The split ring is attached to the sleeve 172 by a plurality of screws 180 (see FIG. 1 ). The lower end of the fins 170 are also provided with a second sleeve 182 surrounding the sleeve 102 of the torque drive element 104. The fins are inserted "L" shaped in elevation, as shown in FIG. 1, and extend radially outwardly to engage the inside surface of the wellhead housing and serve to space and orient the running apparatus vertically within the wellhead, as well as act as a bushing between the stem and wellhead bore.

From the foregoing it can be seen, with reference to FIG. 1, that for the circulating and cementing operation, there is ample flowby, as represented by the arrow 190, which is directed through the passages 36, the annular seal area 32, the vertical slots 88 and space 96, through the passages 126, and out through the spaces between the centralizer fins.

Figure 8:
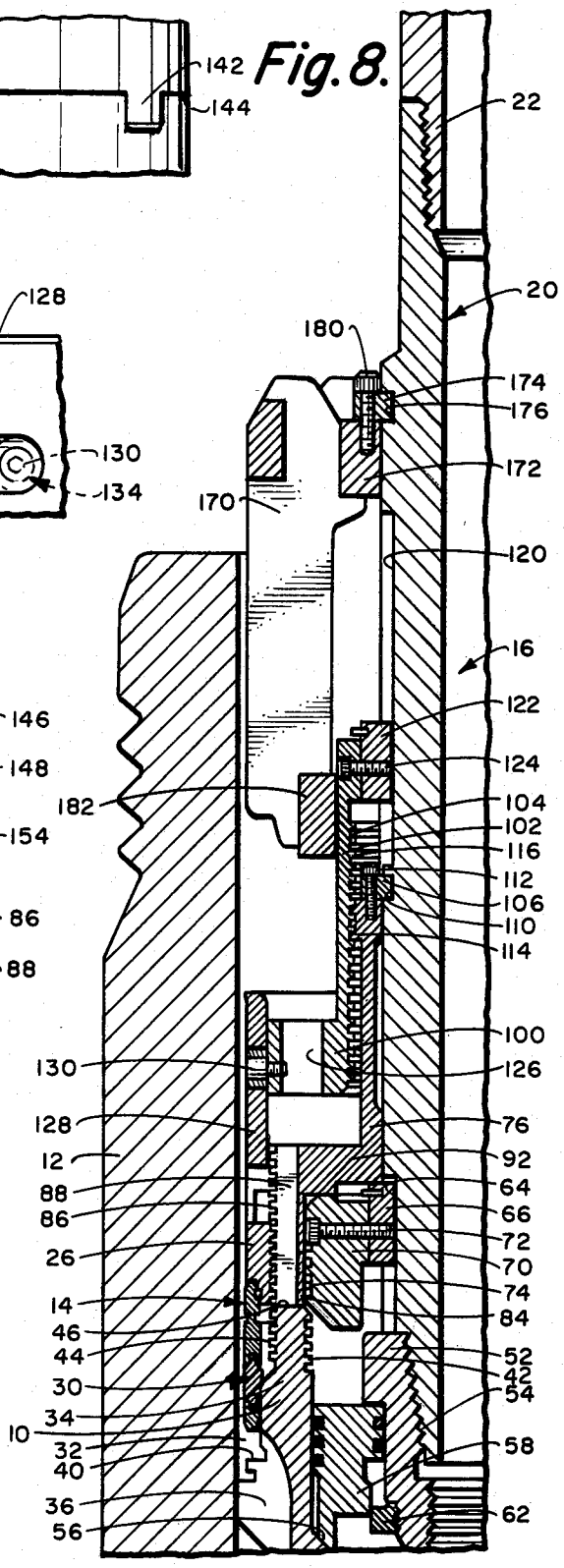
FIG. 8 is an elevational view, similar to FIG. 1, showing the packoff assembly moved part way towards sealing the seal annulus.

Again, after the circulating and cementing operation, a rotation of the stem 50 will cause upward movement of the running thread ring 70 on the threads 42 on the casing hanger and, at the same time, a downward movement of the torque drive element 104 and the torque ring 128 by reason of the threads 114/116 on the torque drive element and stationary ring and threads 86/146 on the stationary thread ring and packing nut 26, respectively, all of which are of the same pitch and are all right hand threads (although all threads could also be left hand, if desired). This is represented by FIG. 8 which shows the running thread moved upwardly and the packoff assembly 30 below the position shown in FIG. 1. Continued rotation of the stem 50 will cause the packoff nut 26 to engage and thread onto the outside threads 44 of the casing hanger body 34, while at the same time the running thread ring 70 has become free of the casing hanger body 34. This is depicted in FIG. 11. Continued rotation will cause the packoff assembly 14 to engage the lower seat 40 in the casing hanger and expand the elastomeric seal 160 sealing the annular seal area 32 against leakage. This is depicted in FIG. 9.

Since the running thread ring 70 is now free of the casing hanger body 34, and since the torque ring 128 is attached to the packing nut 26 only by the interdigitated tongue and groove assemblies 142 and 144, and since the stationary thread ring 76 is in engagement with the end 46 of the casing hanger body 34 by retractable pins 78, the entire running apparatus is free to be withdrawn.

From the foregoing it can be seen that the casing hanger is mechanically held onto the running tool for lowering into the wellhead, that the packoff assembly, being held above the casing hanger provides excellent flowby capabilities for the circulating and cementing operation, and that the lowering of the packoff assembly into the annular seal region is a positive mechanical operation by the continuous threading of the packoff nut from the running apparatus to the external threads on the casing hanger where the packoff seal is energized in a packoff sealing condition.

We claim:

1. An apparatus for supporting a tubular string extending into a well bore from a surrounding wellhead, comprising;

a hanger body adapted to be located in the wellhead and having internal and external threads thereon and at least one sealing surface;

a running tool connectable to a running string;

means releasably connecting said hanger body to said running tool to enable said hanger body to be lowered into the wellhead;

packoff means;

means for supporting said packoff means separately from said hanger body and above said sealing surface while said hanger body is connected to said running tool; and means for disconnecting said packoff means from said supporting means as said releasable connecting means is released from said hanger body, and for moving said packoff means downwardly of said hanger body towards said sealing surface and effecting its sealing engagement of said packoff means with said sealing surface by actuation of said packoff means.

2. The apparatus as claimed in claim 1 wherein said sealing surface is a cylindrical wall spaced from an inner cylindrical wall of said wellhead, thus defining an annular seal area.

3. The apparatus as claimed in claim 2 further having flow passages in said hanger body opening into said annular seal area.

4. The apparatus as claimed in claim 3 wherein said means releasably connecting said hanger body to said running tool comprises threaded means coengageable with said internal threads on said hanger body.

5. The apparatus as claimed in claim 4 wherein said threaded means comprises a running thread ring fixed to said running tool to rotate therewith and moveable axially thereof.

6. The apparatus as claimed in claim 5 wherein said means for supporting said packoff means comprises a stationary thread ring with first external threads coextensive with the external threads on said hanger body engageable with internal threads on said packoff means.

7. The apparatus as claimed in claim 6 wherein said stationary thread ring is detachably, but. non-rotatably, affixed to said hanger body.

8. The apparatus as claimed in claim 7 wherein said stationary thread ring is fixed to said running tool stem so as to be moveable axially therewith, but not rotatable thereby.

9. The apparatus as claimed in claim 8 wherein said stationary thread ring includes passages for the flow of fluid therethrough from said annular seal area.

10. The apparatus as claimed in claim 9 wherein said stationary thread ring also includes means for allowing axial movement of said running thread ring.

11. The apparatus as claimed in claim 10 wherein said stationary thread ring is provided additional external threads, and further including a torque drive element threaded onto said additional external threads and affixed to said running tool so that rotation of said running tool will rotate said torque drive element, threading said torque drive element on said additional external threads, and thus lowering said torque drive element toward said casing hanger.

12. The apparatus as claimed in claim 11 further including a torque ring drivingly connected to said torque drive element and drivingly, but detachably, connected to said packoff means to rotate said packoff means in response to rotation of said torque drive element.

13. The apparatus as claimed in claim 12 wherein said torque drive element and torque ring actuate said packoff means by threading said packoff means from the threads of said stationary thread ring and onto the external threads of said hanger body where said packoff engages an actuating shoulder.

14. Apparatus for supporting a tubular string extending into a well bore from a surrounding wellhead, comprising;

a hanger body adapted to be located in the wellhead and having a sealing surface;

a running tool connectable to a running string;

a first means releasably connecting said hanger body to said running tool to enable said hanger body to be lowered into the wellhead;

packoff means; and a second means releasably connecting packoff means to said running tool and initially positioning said packoff above said hanger body, both of said first and second means being responsive to actuation by said running tool to concurrently release said hanger body from said running tool and move said packoff means from its initial position into engagement with said hanger body and to effect sealing engagement of said packoff means with said sealing surface.

15. The apparatus as claimed in claim 14 wherein said sealing surface is a cylindrical wall spaced from an inner cylindrical wall of said wellhead, thus defining an annular seal area.

16. The apparatus as claimed in claim 15 further having flow passages in said hanger body opening into said annular seal area.

17. The apparatus as claimed in claim 16 wherein said second means includes passages for the flow of fluid therethrough from said annular seal area.

18. The apparatus as claimed in claim 17 wherein said hanger body has internal threads and said first means includes external threads coengageable with said internal threads.

19. The apparatus as claimed in claim 18 wherein said first means comprises a running thread ring fixed to said running tool for rotation, but moveable axially thereof.

20. The apparatus as claimed in claim 19 wherein said hanger body has external threads and said second means comprises a stationary thread ring with first external threads coextensive with the external threads on said hanger body, internal threads on said packoff means, said external threads on said body being engageable with the internal threads on said packoff means.

21. The apparatus as claimed in claim 20 wherein said stationary thread ring is detachably, but non-rotatably, affixed to said hanger body.

22. The apparatus as claimed in claim 21 wherein said stationary thread ring is fixed to said running tool, but not rotatable thereby.

23. The apparatus as claimed in claim 22 wherein said stationary thread ring also includes means for allowing axial movement of said running thread ring.

24. The apparatus as claimed in claim 23 wherein said stationary thread ring is provided additional external threads, and further including a torque drive element threaded onto said additional external threads and affixed to said running tool so that rotation of said running tool will rotate said torque drive element threading said torque drive element on said additional external threads.

25. The apparatus as claimed in claim 24 wherein said torque drive element actuates said packoff means by including means threading said packoff means from the threads of said stationary threaded ring and onto the external threads of said hanger body where said packoff means engages an actuating shoulder.

26. A method of lowering and sealing a casing hanger in a wellhead comprising the steps of;

attaching apparatus onto a running tool which has a casing hanger and a packoff assembly thereon, connecting said running tool and apparatus onto a means for lowering and rotating said running tool into a wellhead located subsea, positioning said casing hanger in said wellhead, said casing hanger being adapted for that purpose, rotating said running tool to release said casing hanger and said packoff assembly from said running apparatus and said packoff assembly to become connected to said casing hanger and to seal said casing hanger with respect to said wellhead.

27. The method of claim 26 wherein said running tool and apparatus are raised from said wellhead.

* * * * *